US007077071B2

(12) United States Patent
Neu

(10) Patent No.: US 7,077,071 B2
(45) Date of Patent: Jul. 18, 2006

(54) DOUBLE-HULL ORE CARRYING VESSEL CONVERSION FROM SINGLE-HULL OIL TANKER AND METHOD OF PERFORMING THE SAME

(76) Inventor: Richard W. Neu, 250 N. Canon Dr., Third Floor, Los Angeles, CA (US) 90210

( * ) Notice: Subject to any disclaimer, the term of this patent is extended or adjusted under 35 U.S.C. 154(b) by 0 days.

(21) Appl. No.: 10/803,816

(22) Filed: Mar. 18, 2004

(65) Prior Publication Data

US 2005/0204982 A1 Sep. 22, 2005

(51) Int. Cl.
*B63B 3/62* (2006.01)

(52) U.S. Cl. ..... 114/65 R; 114/74 A

(58) Field of Classification Search ..... 114/65 R, 114/73, 74 R, 74 A, 72, 201 R
See application file for complete search history.

(56) References Cited

U.S. PATENT DOCUMENTS

| | | | | |
|---|---|---|---|---|
| 3,045,631 | A * | 7/1962 | Hecht | 114/201 R |
| 3,399,645 | A | 9/1968 | Dahan | |
| 3,574,921 | A | 4/1971 | Fiegel | |
| 3,590,466 | A | 7/1971 | Moshammer et al. | |
| 3,742,889 | A | 7/1973 | Weise et al. | |
| 3,797,099 | A | 3/1974 | Myers | |
| 3,811,593 | A | 5/1974 | Bridges et al. | |
| 3,832,966 | A * | 9/1974 | Garcia | 114/74 R |
| 4,230,061 | A | 10/1980 | Roberts et al. | |
| 4,267,789 | A | 5/1981 | Ivanov et al. | |
| 4,331,095 | A | 5/1982 | Margard | |
| 4,476,798 | A | 10/1984 | Backus | |
| 4,548,154 | A | 10/1985 | Murata et al. | |
| 4,573,422 | A | 3/1986 | Murata et al. | |
| 4,660,491 | A | 4/1987 | Murata et al. | |
| 4,674,430 | A | 6/1987 | Murata et al. | |
| 4,907,524 | A | 3/1990 | Hart et al. | |
| 5,085,161 | A | 2/1992 | Cuneo et al. | |

(Continued)

FOREIGN PATENT DOCUMENTS

FR 2 719 545 A1 11/1995

(Continued)

OTHER PUBLICATIONS

Translation of Japanese Kokai Patent Application No. Sho 58[1983]-17408.*

(Continued)

*Primary Examiner*—Sherman Basinger
(74) *Attorney, Agent, or Firm*—Thompson Coburn LLP

(57) ABSTRACT

A method for converting a single-hull vessel to a double hull vessel, and the converted double hull vessel, is disclosed. The single hull vessel to be converted has an outer hull surrounding a center cargo tank flanked by a port wing tank and a starboard wing tank, with spaced-apart transverse bulkheads extending between the port and starboard wing tanks to form one or more central tanks. An elevated floor is added to the central cargo tanks by installing new bottom plating spanning the transverse bulkheads and the sidewalls of the wing tanks. Support members are added to increase the strength of the elevated floor, the cargo tank, and the wing tanks, as needed. A sealed compartment is formed by the new elevated floor, the outer hull, and the sidewalls and bulkheads to protect the cargo from leaking out of the vessel should the integrity of the single hull be breached. The method achieves conversion of the single hull vessel to a double hull construction without breaching the integrity of the pre-existing single outer hull, and thus is faster and easier in converting single hull vessels to minimize cost of conversion and vessel outage.

23 Claims, 3 Drawing Sheets

U.S. PATENT DOCUMENTS

| | | | |
|---|---|---|---|
| 5,090,351 | A | 2/1992 | Goldbach et al. |
| 5,189,975 | A | 3/1993 | Zednik et al. |
| 5,218,919 | A | 6/1993 | Krulikowski, III et al. |
| 5,320,056 | A | 6/1994 | Marinzoli |
| 5,445,097 | A | 8/1995 | Fujita et al. |
| 5,469,799 | A | 11/1995 | Iwai et al. |
| 5,477,797 | A | 12/1995 | Stuart |
| 5,542,365 | A | 8/1996 | Jurisich et al. |
| 5,582,124 | A | 12/1996 | Sikora et al. |
| 5,899,162 | A | 5/1999 | Beaupre et al. |
| 6,003,459 | A | 12/1999 | Nielsen |
| 6,009,821 | A | 1/2000 | Al-Rammah et al. |
| 6,170,420 | B1 | 1/2001 | Hagner et al. |
| 6,357,373 | B1 | 3/2002 | Hagner et al. |
| 6,637,359 | B1 | 10/2003 | Hagner et al. |
| 6,708,636 | B1 * | 3/2004 | Hagner ..... 114/74 A |
| 6,907,836 | B1 * | 6/2005 | Hagner ..... 114/74 A |
| 2002/0124784 | A1 | 9/2002 | White et al. |

FOREIGN PATENT DOCUMENTS

| | | | |
|---|---|---|---|
| JP | 353040995 A | * | 4/1978 |
| JP | 358174078 A | * | 10/1983 |
| JP | 58174078 | | 1/1984 |
| JP | 61-024685 | | 3/1986 |
| JP | 61-024686 | | 3/1986 |
| JP | 61-81290 | * | 4/1986 |

OTHER PUBLICATIONS

Translation of JP 53040995 published 19780413.*

* cited by examiner

DOUBLE-HULL ORE CARRYING VESSEL CONVERSION FROM SINGLE-HULL OIL TANKER AND METHOD OF PERFORMING THE SAME

BACKGROUND OF THE INVENTION

The present invention relates to the conversion of a single-hull vessel into a double hull vessel. More specifically, the present invention relates to the conversion of a single hull oil tanker into a double hull ore carrying vessel. Yet more specifically, the present invention relates to the conversion of a single hull vessel into a double hull vessel, wherein the single hull vessel has pre-existing port and starboard wing tanks flanking a center cargo tank and an elevated floor is added in the bottom of the center cargo tank spanning the sidewalls of the wing tanks to provide a sealed compartment interposed between the center cargo tank and the bottom of the outer single hull. The present invention also includes the installation of a hatch in a deck of the vessel to provide access to the center cargo tank from above.

Currently, many single hull oil tanker marine vessels are approaching forced retirement because of the regulations in the shipping industry which require double hull vessels. At the present time, there are hundreds of single hull tankers which will soon no longer be able to trade in the United States or Europe where the present-day requirements call for double hull tankers. In fact, in many jurisdictions, there is a mandated phasing out of single hull tankers. There has also been a long period of under-investment in the tanker industry as a whole. Therefore, the value of these tankers has diminished. A significant number of these vessels are of high structural and operational quality. However, because of new legislation and other regulations, this large existing fleet of single hull vessels is being prematurely forced out of service.

The regulations requiring that oil tanker marine vessels have a double hull construction for the transport of oil and other hazardous liquids are currently being extended to cover other transport vessels, including those suited for carrying bulk materials such as iron ore. The number of double hull vessels suited for carrying these bulk materials is relatively small and new construction of such vessels is relatively expensive and a time consuming process. In fact, at the present time, there is a worldwide shortage of dry bulk shipping vessels including ore carriers, and a short-range forecast shows that limited plans for new construction portend a shortage for some time.

Thus, there is a need in the industry for double hull vessels configured to carry dry bulk materials while at the same time there is a significant inventory of existing single hull vessels which will be forced out of service.

There are examples in the prior art of efforts to convert single hull vessels to double hull vessels to meet these new regulations, as well as new designs for double hull vessels built from original designs therefor. One such example is shown in U.S. Pat. No. 3,399,645, issued in 1968, which discloses a double hull vessel originally built to design in recognition of the problems and risks associated with single hull vessels carrying environmentally unfriendly cargoes. In that patent, imperforated transverse bulkheads are provided to divide the cargo section into a row of center cargo tanks flanked by two rows of wing tanks. Then, an imperforated innerbottom is spaced from the bottom of the hull and extends the width and length of the cargo section to form the bottom of the center and wing tanks. Thus, with this construction, the center cargo tanks are isolated from the single outer hull by sealed compartments, and the bottom of the center cargo tanks are spaced above the bottom of the hull. However, this patent does not disclose or suggest a method for converting a single hull vessel to double hull.

Prior art U.S. patents that disclose apparatus and methods for converting single hull vessels to double hull vessels include U.S. Pat. Nos. 5,189,975 and 6,357,373. In the '975 patent, entitled "Method for reconfiguration tankers", a method is disclosed for a mid-deck conversion which includes cutting the hull of a conventional single hull tanker longitudinally along a horizontal plane well below the normal laden water line and interposing a new mid-deck spacer member including a new transverse mid-deck between the lower and upper portions of the midship cargo section. Obviously, with this method, considerable effort and expense is required in order to literally split the original hull in two, separate the two pieces, and insert/install a new mid-deck construction. In the '373 patent issued in 2002, entitled "Rebuilt double hull vessel and method of rebuilding a single hull vessel into a double hull vessel", an existing single hull vessel is rebuilt by cutting and removing the topside decking and internal vessel structure and inserting an inner hull structure within a volume defined by the original hull. The new inner hull is prefabricated as a plurality of modular sections, and the prefabricated modules are fitted over the top of the existing bottom framing members and joined to the existing framing members at the sides. This is also described as creating a new trunk structure which is "dropped" into the opening formed in the topside deck plating when the cut out section of deck plating is removed. Again, as with the '975 patent, substantial re-configuration of the original structure is required, involving significant effort and expense.

Still another prior art publication is a Japanese abstract, publication number 61-024685 published in 1986 and entitled "Method of reconstructing existing tanker into double hull tanker". Reading from an abbreviated translation, this reference teaches a method requiring the cutting off of the side bottom portion of the hull and adding an inner bottom and a longitudinal bulkhead. Again, substantial reconfiguring of the original vessel is required including cutting through the original hull.

The disclosures of these prior art references are incorporated herein by reference, but are not believed to detract from the patentability of the present invention.

SUMMARY OF THE INVENTION

The present invention comprises a completed converted double hull vessel, as well as the method for achieving such conversion. Preferably, a single hull oil tanker is converted into double hull ore carrying vessels, although it is within the scope of the invention that other types of single hull vessels may be converted into different transport ships of double hull construction. Using the method of this invention, the conversion may be accomplished in a fraction of the time and cost normally associated with the new construction of an original design double hull vessel, or as associated with the methods and construction of the prior art known to the inventor especially as taught by the prior art references cited above.

One aspect of the invention comprises converting a single hull vessel of somewhat standard construction and having an outer-hull surrounding a center cargo tank flanked by an existing port wing tank and an existing starboard wing tank with existing spaced apart transverse bulkheads extending between the port and starboard wing tanks. Within this standard construction, an elevated floor is formed by new bottom plating which is adapted and configured to be installed in the center cargo tank(s) and spaced above the outer hull. The new bottom plating forms a new inner bottom in the new center cargo tank(s) by spanning the sidewalls of the port and starboard wing tanks. The sealed space formed between the new elevated floor, the original hull, and the existing port and starboard wing tank sidewalls protect the center cargo tank(s) in the event the vessel outer hull is penetrated. The center cargo tank(s) may be configured to carry bulk materials.

Preferably, a new hatch is adapted and configured to be installed in a topside deck of the vessel. The hatch provides access to the center cargo tank(s), for instance, for the unloading and loading of bulk materials from the newly converted center cargo tank(s). The hatch may be formed sufficiently large enough to allow the new elevated floor to be moved through the hatch into the center cargo tank in large sections, for instance, pre-fabricated or modular sections.

The single hull vessel may have a center cargo tank with a center longitudinal bulkhead that divides the center cargo tank into a port center cargo compartment and a starboard center cargo compartment. The vessel may also have a center cargo tank which comprises a plurality of center cargo compartments arranged longitudinally along a centerline of the vessel. All of these alternate constructions found in existing single hull vessels are amenable to the method of the present invention for conversion to a double hull vessel.

Another aspect of the invention comprises a method for achieving the conversion. In accordance with steps of the method of the present invention, a single hull vessel is provided with an outer hull surrounding at least one center cargo tank formed in an interior of the vessel. The center cargo tank is spaced from the outer hull by a port side longitudinal bulkhead and a starboard side longitudinal bulkhead and at least two spaced apart transverse bulkheads extending between the port and starboard side longitudinal bulkheads. An elevated floor preferably comprised of new bottom plating is installed in at least one of the center cargo tanks of the single-hull vessel to form a sealed compartment, or second hull separating the center cargo tanks from the first hull. The new bottom plating is preferably attached to and spans the port and starboard side longitudinal bulkheads and the spaced apart transverse bulkheads. Various supports and framing members are preferably added to increase the strength of the newly added elevated floor and surrounding compartments.

Preferably, the method further comprises installing a hatch in a topside deck of the vessel to provide access to the center cargo tanks. Preferably, the new hatch is dimensioned sufficiently large enough in relation to the center cargo compartment to permit installation of the new elevated floor in large modular sections and to provide improved loading and unloading of the center cargo tank.

In accordance with a provision of the method, supports and framing members may be provided to support the elevated floor, and the supports and framing members may include longitudinal framing for the bottom plating. In another aspect of the invention, the method may comprise configuring a support structure in the new inner bottom for the new bottom plating in accordance with a load to be transported in the center cargo tank. The method may also include the step of configuring a support structure for the spaced apart transverse bulkheads and the port and starboard side longitudinal bulkheads in accordance with a load to be transported in the center cargo tank.

As will be seen from the description that follows, the present invention allows for conversion of single hull vessels into double hull vessels which comply with many new or soon to be adopted international laws regarding construction of such ships. Further objects and teachings of the invention are revealed in the following detailed description of the preferred embodiment of the invention and in the following drawing figures.

BRIEF DESCRIPTION OF THE DRAWINGS

Corresponding reference numbers indicate corresponding parts throughout the several views of the drawings.

DETAILED DESCRIPTION OF THE PREFERRED EMBODIMENT

Figure 1:
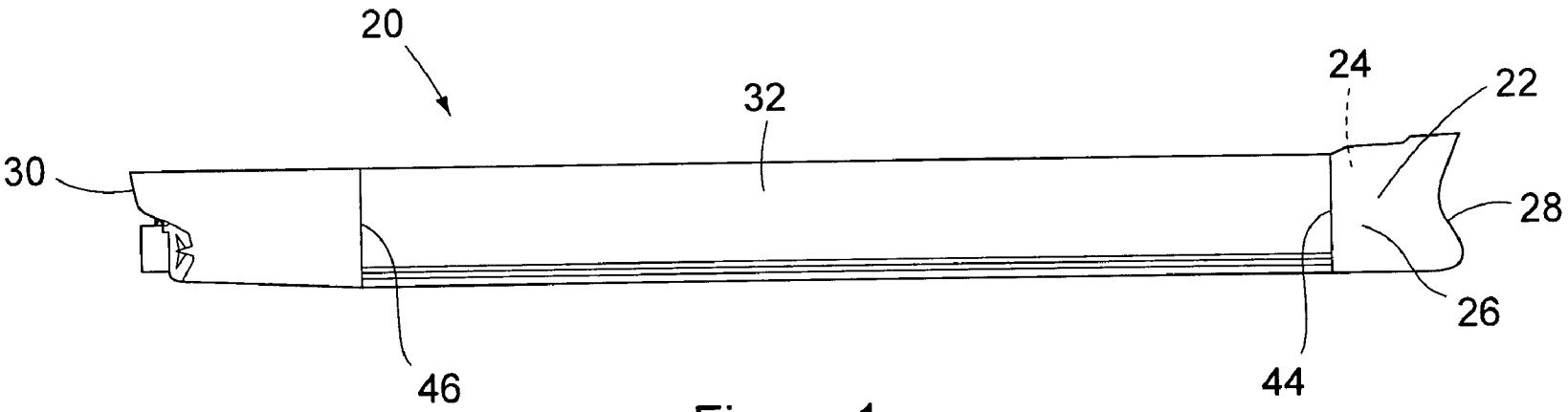
FIG. 1 shows a side elevation view of a single hull vessel of representative construction before conversion to double hull using the principles of the present invention.
Figure 2:
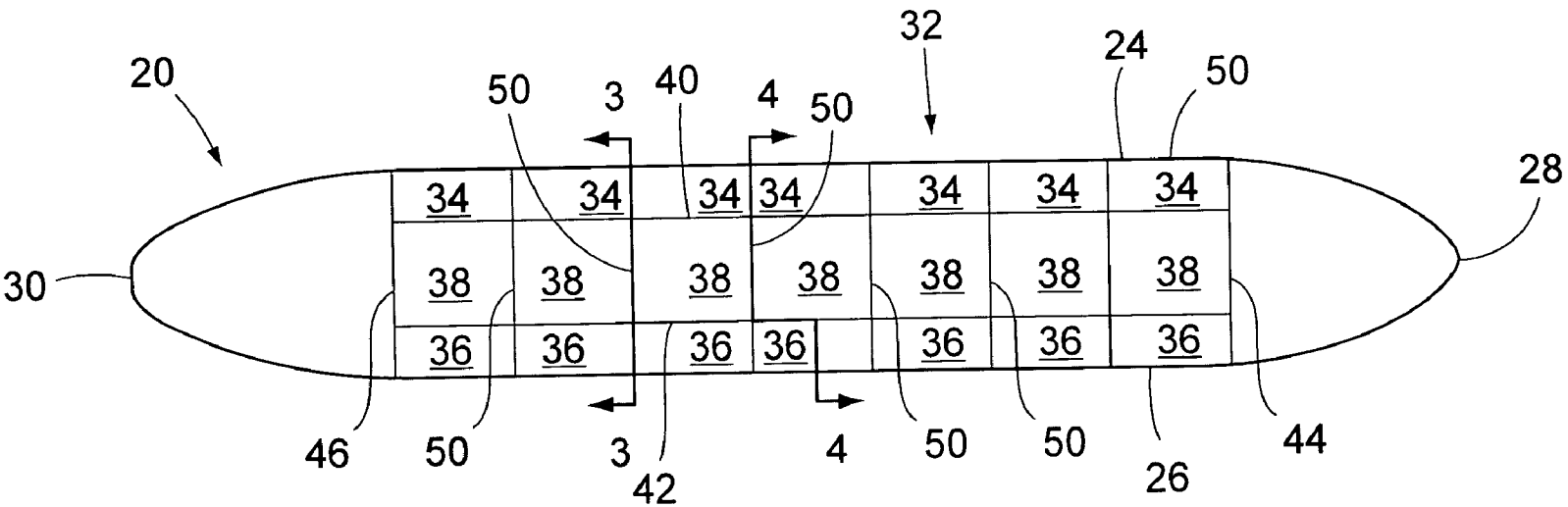
FIG. 2 shows a top view of the single hull vessel of FIG. 1.
Figure 3:
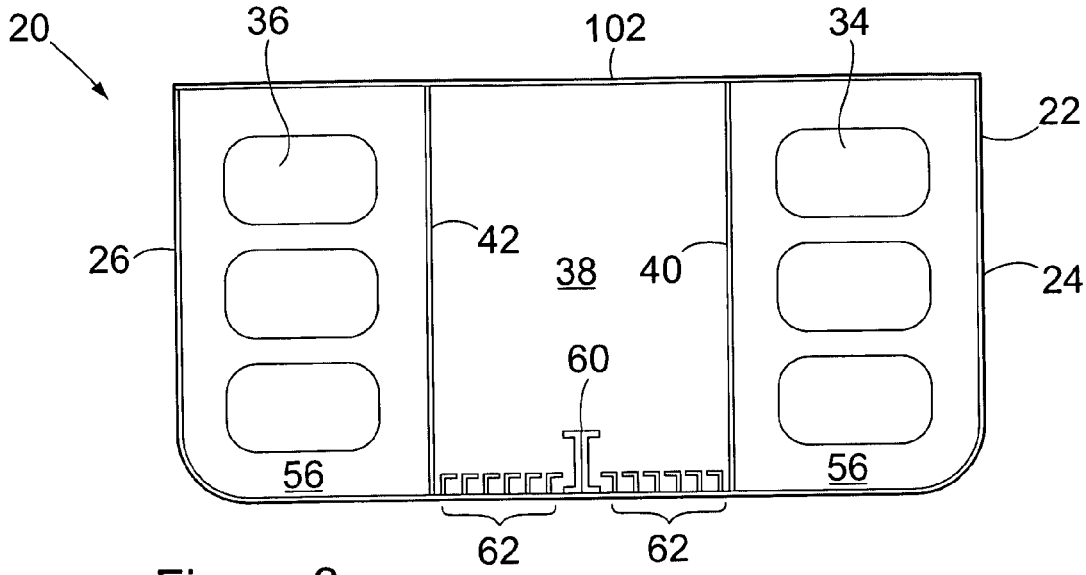
FIG. 3 shows a cross-sectional view of the amidships section of the single hull vessel taken along lines 3—3 of FIG. 2.

FIGS. 1—3 show a single hull vessel 20 that may be converted using the principles of the present invention. The vessel 20 has an outer hull structure 22 generally defining the shape and body of the vessel to which the remaining structure of the vessel is attached. As is customarily known in the art, the vessel has port and starboard sides 24,26, a bow 28 and a stern 30 with an amidships portion 32 of the vessel therebetween. The vessel also typically has a pilot house, accommodations, rigging and deck structure. These structures have been omitted from the drawings for the purposes of simplifying the explanation herein.

The vessel 20 shown in FIG. 2 is a typical single hull oil tanker. In the amidships 32 portion of the vessel, the vessel has a port side wing tank 34 running longitudinally along the port side 24 of the vessel and a starboard side wing tank 36 running longitudinally along a starboard side 26 of the vessel. Between the port and starboard wing tanks 34,36, the vessel has a center cargo tank 38. Typical, the center cargo tank 38 is arranged longitudinally along a centerline of the vessel in the amidships portion of the vessel. As shown in FIG. 2, the port and starboard wing tanks 34,36 and the center cargo tank 38 are defined by port and starboard bulkheads or sidewalls 40,42 that extend longitudinally along the vessel and spaced apart forward and aft transverse bulkheads 44,46. The port side longitudinal bulkhead 40 and the port side 24 of the outer hull along with the spaced apart forward and aft transverse bulkheads 44,46 typically define the port side wing tank 34. The starboard side longitudinal bulkhead 42 and the starboard side outer hull 26 along with the spaced apart forward and aft transverse bulkheads 44,46 preferably define the starboard wing tank 36. The port and starboard longitudinal bulkheads 34,36 along with the spaced apart forward and aft transverse bulkheads 44,46 define the center cargo tank 38. Additionally, the vessel is provided with a plurality of intermediate transverse bulkheads 50 that are interposed in each of the port and starboard wing tanks and the center cargo tank. The intermediate transverse bulkheads 50 subdivide the port and starboard wing tanks 34,36 into separate compartments. The intermediate transverse bulkheads 50 also subdivide the center cargo tank 38 into a plurality of cargo compartments 52 which are arranged in a longitudinal line along the centerline of ship. As used herein, sets of intermediate spaced apart transverse bulkheads may, in certain circumstances, depending upon the vessel tank arrangement, include one or both of the forward and aft transverse bulkheads. Thus, the terms spaced apart transverse bulkheads should not be limited to any specific transverse bulkheads located in any specific portion of the vessel.

Although FIGS. 1–3 show a typical oil tanker which is eligible for conversion using the principles of the present invention, it should be appreciated that other types of vessels may also be converted using the principles of the invention set forth herein, including OBO type vessels. These vessels may also include self-propelled vessels and barges. The vessels may also have other tank arrangements. For instance, the vessel may have only forward and aft transverse bulkheads, or the vessel may have additional longitudinal bulkheads, for example, an additional centerline bulkhead (FIG. 5) that divides the center cargo tank into port and starboard cargo compartments. The principles of the invention may be incorporated into each of these vessel designs and with a variety of tank arrangements. In fact, the principles of the invention may be used on a specific single cargo compartment in a multi-cargo compartment vessel as will become evident from the description that follows below.

FIG. 3 shows a typical cross-section of the amidships portion 32 of a typical single hull vessel. As shown in FIG. 3, the center cargo tank 38 is bordered by port and starboard wing tanks 34,36. Web frames 56 are shown in the port and starboard wing tanks 34,36 to support the port and starboard longitudinal bulkheads that define the center cargo tank 38. A center longitudinal girder 60 and other longitudinal framing 62 are shown in the bottom of the center cargo tank 38 as is typical of a single hull oil tanker vessel which is one type of vessel that may be converted using the principles of the invention.

Figure 4:
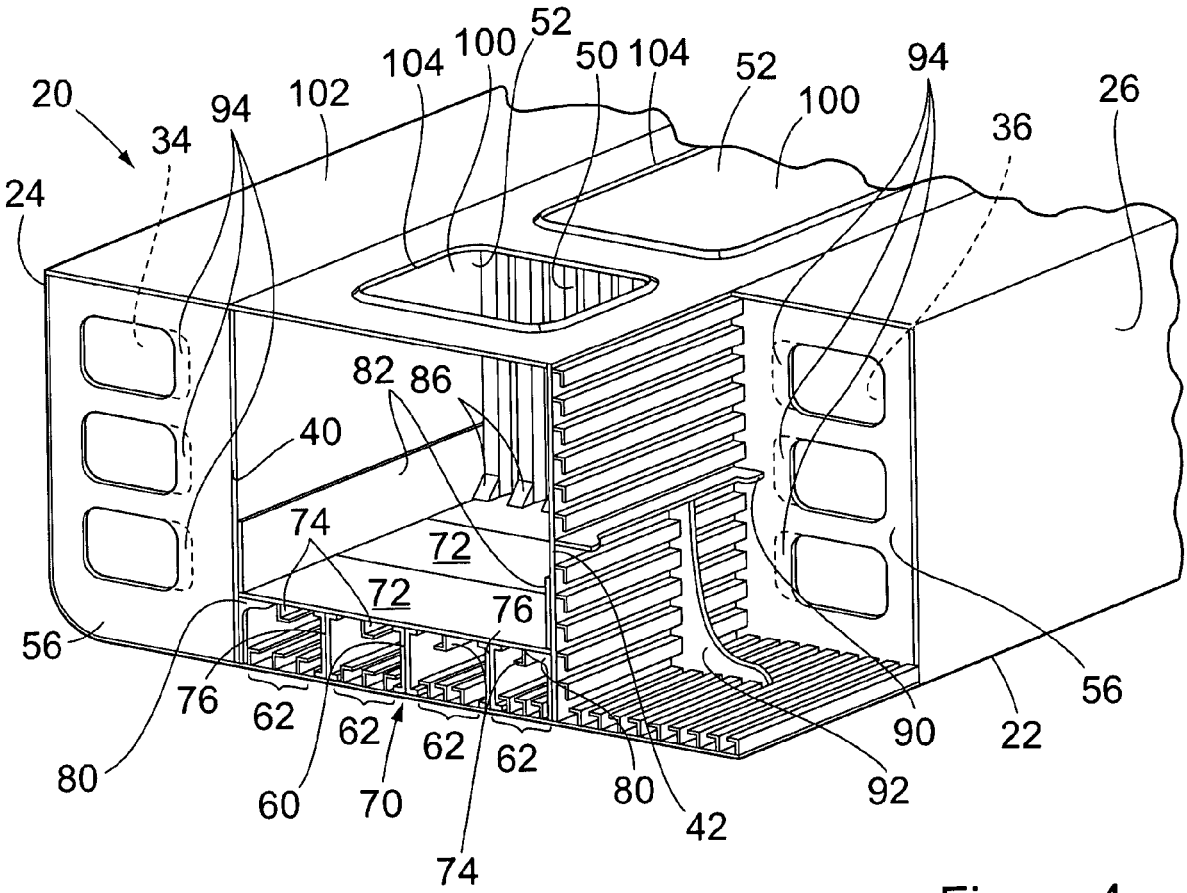
FIG. 4 shows a perspective of a cross-sectional view of the amidships cargo area of a single hull vessel taken along lines 4—4 of FIG. 2 after conversion with an elevated floor comprised of new bottom plating installed in the center cargo tank to form a new sealed compartment separating the cargo from the outer hull, and with a cut away to detail the added supporting structure in the wing tank.

FIG. 4 provides details of the conversion of the single hull vessel into a double hull vessel using the principles of the invention. The converted single hull of FIG. 4 shows a preferred embodiment of the invention where the center cargo tank 38 is configured for carrying bulk granular materials, although it should be appreciated that the center tank cargo hold of the single hull vessel may be converted and configured to carry other materials, including liquids and gases. To simplify the discussion herein, the conversion of a single hull oil tanker into a double hull ore-carrying vessel will be described, although the same principles may be used to convert other vessels to carry other types of cargo, it not being considered that the type of cargo has a limiting effect on the scope of the invention.

Referring to FIG. 4, an added elevated floor 70 is installed in the center cargo tank 38. The elevated floor 70 preferably comprises a plurality of new horizontal bottom plates 72 which are preferably installed without pre-assembly in the center cargo tank and extend between the existing port and starboard longitudinal bulkheads 40,42. Longitudinal stiffeners 74 are preferably provided on the new bottom plates 72 to provide a longitudinal framing system which aligns with the longitudinal framing system already existing in the center cargo tank and used along the already existing longitudinal bulkheads. Preferably, the bottom plates 72 comprise intermediate transverse flooring which extends between the port and starboard longitudinal bulkheads to control deflection. The scantlings for the inner bottom and the bottom plating are designed in a manner to support the intended cargo to be loaded in the center cargo tank and to increase the hull section modulus. Preferably, two large longitudinal girders 76 are installed on either side of the center girder 60 to increase the hull section modulus and to support the new bottom plates 72. Depending on the particular cargo to be transported in the vessel, the center girder 60 may also be strengthened or reinforced. Large corner brackets 80 are preferably installed in the corners of the new elevated floor 70 where the new bottom plates 72 meet the port and starboard longitudinal bulkheads 40,42 to provide additional support for the new bottom plates 72.

To accommodate grab loads, additional plating 82 may be installed adjacent the port and starboard longitudinal bulkheads, upstanding from the new bottom plates 72. The transition point between the new bottom plates 72 and the port and starboard longitudinal bulkheads 40,42 is preferably formed with a watertight boundary to prevent leakage of the cargo in the center tank cargo hold into the new inner bottom and to provide a sealed compartment between the center cargo and the outer hull.

In the example of the conversion of an oil tanker to an ore carrying vessel, as the weight of the bulk granular materials to be transported in the center cargo compartment is generally more than the oil previously carried in the vessel's cargo hold, the forward and aft transverse bulk heads and the port and starboard longitudinal bulkheads are preferably further reinforced. The transverse bulkheads 50 are preferably reinforced by introducing upper stools (not shown) and lower stools 86 on each bulkhead. Brackets (not shown) may also be used to provide strengthening for the transverse bulkheads. The longitudinal bulkheads 40,42 are reinforced by providing horizontal stringers 90 and large gussets 92. Preferably, the horizontal stringers 90 are provided along the longitudinal bulkheads between existing transverse web frames 56. To provide additional strengthening for the longitudinal bulkheads 40,42, the transverse web frames 56 may also be strengthened, for example, by increasing the shear area 94 in the existing web frame. Because the port and starboard wing tanks are generally not altered in the conversion under the principles of this invention, the wing tanks provide access to allow the aforementioned modifications to the port and starboard bulkheads. Depending upon the arrangement of the tanks in the vessel, the intermediate transverse bulkheads and/or the centerline longitudinal bulkhead (if present) may also be reinforced in a similar manner.

The preexisting port and starboard longitudinal bulkheads may be repaired, replaced or reinforced as necessary depending upon their structural integrity. For instance, a wall structure may be erected along side a longitudinal bulkhead in a specific cargo compartment to form a new interior barrier for the center cargo compartment. In this arrangement, the elevated floor need only extend to the newly erected wall structure, and the watertight boundary may be formed between the wall structure and the elevated floor and not the preexisting longitudinal bulkhead.

As shown in FIG. 4, a hatch 100 and hatch cover (not shown) is preferably installed in a topside deck 102 of the vessel to provide access to the center cargo tank 38 and/or cargo compartment. Preferably, a plurality of hatches and hatch covers are installed in the deck of the ship to provide access to the center cargo compartments converted in accordance with the principles of the invention. As is known in the art, the hatch covers may also comprise two-piece hatch covers. The hatches 100 may be formed as necessary in the deck depending upon the type of cargo to be transported in a cargo compartment. The hatches may also be formed over a single specific cargo compartment converted in accordance with the principles of the invention.

In order to maintain or increase the hull section modulus of the single-hull vessel, continuous hatch coamings 104 and insert plates may be formed adjacent the hatches. Preferably, the hatch coamings have a depending portion that extends downward through the hatch to provide additional structural steel for reinforcement of the deck and the coamings. The depending portions of the hatch coamings may extend transversely across the underside of the deck and form a transverse girder below the deck. The depending portions of the hatch coamings may extend longitudinally across the underside of the deck and form a longitudinal girder below the deck. The hatch may also be ribbed and lined to prevent a dry cargo such as iron ore from collecting in the ribs of the ship which would add weight and be difficult to completely unload or remove. The deck and side stringer plates may be partially reinforced through the addition of corner doubles around the hatch and by the addition of strips around the hatch. All this additional bracing and strengthening may be added, or other similar additional bracing and strengthening may be added as determined by the use, cargo, choice of materials, and otherwise in accordance with good practices in ship building as known in the art and is not considered to be limiting to the scope of the invention.

The existing piping, if any, in the center cargo tank previously used for the movement of oil between cargo compartments and the loading and unloading of oil from the vessel may be converted into a bilge pumping system (not shown) for the new inner bottom. The existing cargo pumps will generally have sufficient capacity to be used as a bilge and drain system for the new inner bottom. Thus, the conversion set forth herein will generally not increase electrical loads or electrical generation requirements for the vessel. The piping systems employed in the port and starboard wing tanks may generally be left as is for water ballast purposes.

Figure 5:
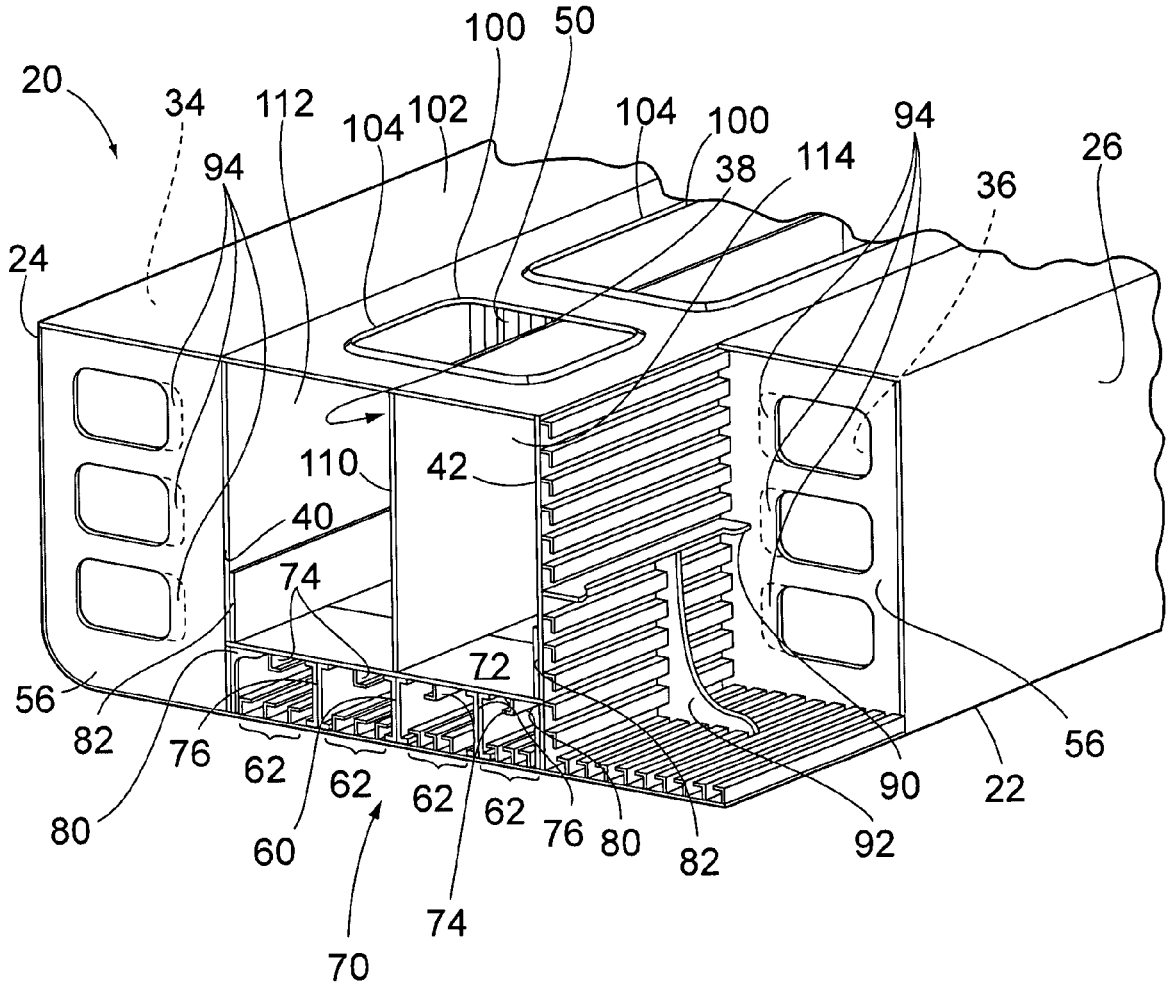
FIG. 5 is an alternate embodiment of converted single hull vessel of FIG. 4 showing a longitudinally partitioned center cargo tank.

FIG. 5 shows an alternate embodiment of the conversion of the single hull vessel of FIG. 4 where the center cargo tank 38 is partitioned by a centerline longitudinal bulkhead 110 extending along the center line of the vessel to form port and starboard cargo compartments 112,114. The new bottom plates 72 are installed in each of the port and starboard cargo compartments to form the new elevated floor in each compartment. A hatch cover may be provided for the hatch of the port cargo compartment and a second hatch cover may be provided for the hatch of the starboard cargo compartment. In this arrangement, a one-piece hatch cover may be used for both the port and starboard cargo compartments.

As shown in FIGS. 4 and 5, the port and starboard wing tanks 34,36 and the spaced apart transverse bulkheads 50 along with the new elevated floor 70 form an internal space around the center cargo tank 38 which protects the center cargo tank in the event the outer hull is penetrated. The boundary created around the center cargo tank 38 by the new bottom plates 72 and the existing spaced apart transverse bulkheads 50 and the port and starboard longitudinal bulkheads 40,42 prevent leakage from the center cargo tank in the event the outer hull is penetrated. Depending upon the arrangement of the cargo compartments 52 in the vessel, the new bottom plating in the center tank provides an additional layer of protection for individual cargo compartments.

As an indirect benefit of the conversion using the principles of the invention set forth herein, the hatches in the deck of the converted vessel may have a relatively large size in relation to the cargo compartment. First, to facilitate conversion, the relatively larger hatch size permits the elevated floor to be installed in the center cargo compartment, if not as a complete unit, then in large semi-finished or modular sections. This reduces conversion time by allowing large sections of the elevated floor to be pre-fabricated and staged for expeditious installation once the required openings are made in the deck.

The relatively larger hatch size in relation to the center cargo compartment also provides an advantage over the prior art designs of hatches for traditional bulk carrying vessels in that the relatively larger hatch size provides improved access to the cargo compartment for efficient loading and unloading of the bulk cargo with a conventional gantry crane fitted with a grab and positioned vertically above the cargo compartment. In traditional bulk carrying vessels, the width of the hatch, i.e. the dimension of the hatch in the transverse direction of the vessel, is much smaller than the dimension of the hatch along a longitudinal direction of the vessel. In many designs, the ratio is less than fifty percent. In a traditional ship construction, this design criterion is used to ensure there is sufficient space on the deck of the vessel for placing the hatch cover between the hatch coaming and the side of the vessel when accessing the cargo compartment. The design criterion also ensures that there is sufficient structural steel in the deck, and thus sufficient structural integrity for the vessel.

As the loading of bulk cargo is normally carried out by conveyor belts or cranes with grabs which drop the bulk cargo vertically into the cargo compartment, the relatively small hatch on a traditional bulk cargo vessel reduces access to the cargo compartment. Specifically, the loading equipment's access to the outer parts of the cargo compartment is reduced by the deck, which often extends over and overhangs the cargo compartment. Consequently, the loading of bulk materials into the cargo compartment often requires a secondary operation of trimming to ensure the bulk materials are evenly distributed throughout the cargo compartment.

Likewise, the relatively small hatch in traditional bulk cargo vessels also hinders the unloading operation. Normally, unloading is carried out by a gantry crane with a large grab which is lowered into the cargo compartment. The crane is limited in its movement in the transverse direction of the vessel in the cargo compartment as the deck overhang often limits access to the outer parts of the cargo compartment. Consequently, the unloading of bulk materials into the cargo compartment often requires an additional preliminary unloading operation to move the bulk materials to an area in the cargo compartment that can be accessed vertically by the crane and the grab.

In accordance with the principles of the invention, the hatch installed in the deck of the converted single hull vessel may have a relatively larger size in relation to the cargo compartment because a large amount of structural steel already exists in the deck over the wing tanks which as stated before remain as is. The pre-conversion structural integrity of the vessel created by the prior solid deck may be restored or increased using the principles described above with respect to the installation of the hatch coamings and inserts, and if needed, the double cornering, etc., without the need to limit the transverse dimension of the hatch. The deck space provided above the wing tanks also provides sufficient area for placement of the hatch during access to the cargo compartment. Consequently, the size of the hatch, and specifically, the relative transverse dimension of the hatch may be increased.

In accordance with the present invention, a method is also provided for converting a single hull vessel into a double hull vessel. In accordance with this method, the single hull vessel 20 is provided with an outer hull 22 surrounding the center cargo tank 38 formed in an interior of the vessel wherein the center cargo tank is spaced from the outer hull by an existing port side longitudinal bulkhead 40 and the existing starboard side longitudinal bulkhead 42 and existing spaced-apart transverse bulkheads 50 extending between the existing port and the starboard longitudinal bulkheads. The existing port side longitudinal bulkhead 40 and an existing starboard side longitudinal bulkhead 42 and existing spaced-apart transverse bulkheads 50 may define the respective existing port and starboard wing tanks. New inner bottom plates 72 are installed in the center cargo tank 38 to form the new elevated floor 70. The bottom plating is attached, such as by welding for example, to the existing port and starboard side longitudinal bulkheads and the existing spaced-apart transverse bulkheads. The new bottom plating preferably extends between or spans the existing port and starboard wing tanks, and is preferably attached such as by welding thereto. A watertight boundary is thus preferably formed in the center cargo tank between the new bottom plating and each of the existing spaced-apart transverse bulkheads and the existing port and starboard longitudinal bulkheads, or sidewalls. The watertight boundary prevents leakage from the center cargo tank in the event the outer hull of the vessel is penetrated, and similarly prevents leaking should the watertight boundary be breached.

A hatch 100 may be installed in the deck 102 of the vessel to provide access to the center cargo tank 38 depending upon the intended cargo to be stored therein. Preferably, the step of providing a hatch includes sizing the hatch sufficiently large enough in relation to the center cargo tank to permit large, modular sections of the elevated floor to be moved through the deck and the hatch into the center cargo tank. The step of providing a hatch may also include sizing the hatch sufficiently large enough in relation to the center cargo tank to permit access to substantially all areas of the center cargo tank by a crane positioned above the center cargo tank. Preferably, the method further comprises pre-fabricating large sections of the elevated floor and moving the large, pre-fabricated sections of the elevated floor through the hatch before installation. Additionally, the method further comprises providing longitudinal framing for the bottom plating and elevated floor to increase the hull section modulus of the vessel. The step of providing longitudinal framing for the vessel may also comprise providing port and starboard side longitudinal girders 76 in the inner bottom 70. The center cargo tank may be fitted with plating 82 along a lower perimeter of the center cargo tank above the new bottom plating 72. The plating 82 may be used to reinforce the longitudinal bulkheads in the center cargo tank or cargo compartment to allow the use of grab loads for the loading and unloading of cargo stored therein.

It is foreseen that the conversion in accordance with the principles of the invention will generally not adversely affect the strength or fatigue life of the vessel. Because the wing tanks will be empty roughly half of the converted vessel's life, i.e. when the vessel is carrying cargo in the center tank, the fatigue of critical members on the vessel's sides will be subject to compressive loads when loaded with cargo. In the vessel's previous life as an oil tanker, the wing tanks were always full. Thus, the outer hull of the vessel on its port and starboard sides were subject to stress loads. Stress loads are often more critical on the vessel's fatigue life. Thus, with the conversion under the principles of the invention set forth herein, the vessel's fatigue life may improve as an ore carrier.

Much of the work methods and practices contemplated to be used in the conversion is known in the art. Cuts made in the deck may be made using conventional techniques already known in the art. Similar techniques of cutting and welding may be employed in other areas to carry out the principles of the invention. The cutting apart of pre-existing vessels and the insertion of new sections and equipment is also known in the art, as exemplified by the disclosures of the prior art references noted above. Many of the brackets and plating used to form the structures in accordance with the conversion may be prefabricated and pre-staged for use in the vessel, thereby reducing lost time in use of the vessel. Choices for materials and sizing of the bottom plating, added support structures, girders, and the like are all within the ordinary skill in the art.

As various changes could be made in the above constructions and methods without departing from the scope of the invention, it is intended that all matter contained in the above description or shown in the accompanying drawings shall be interpreted as illustrative and not in any limiting sense. For example, one or more sections of the elevated floor may be pre-assembled prior to final installation within a cargo tank, or some of the supporting structure attached to one or more bottom plates, or the individual bottom plates may be brought to the cargo tank and individually installed, depending on the size of the hatch, the cargo tank, the facilities available to handle preformed floor assemblies, etc. The bottom plates are shown as being generally rectangular in shape, although other shapes may be conveniently used. The bottom plates are shown to be arranged orthogonally within the cargo tank, but other arrangements are contemplated as well, such as for example diagonally. Although many suggestions are included herein for specific added structural support members, this is considered by and large to be a matter of design choice, depending on the original vessel design, intended use, intended cargo, etc. The invention therefore shall be limited solely by the scope of the claims set forth below and their legal equivalents.

What is claimed is:

1. A vessel converted from a single outer hull construction with a spanning, single elevation, pre-located, topside deck into a double hull construction without alteration of the single outer hull and maintaining the topside deck at a single elevation, said single hull vessel having a central cargo tank flanked on either side by port and starboard wing tanks, said central cargo tank being defined by pre-located port and pre-located starboard sidewalls and pre-located fore and aft transverse bulkheads, and an added elevated floor in said central cargo tank, said elevated floor spanning said pre-located sidewalls and said pre-located bulkheads to define within said outer hull a sealed compartment separating the central cargo tank from the outer hull, said spanning elevated floor being of substantially a single elevation and substantially parallel to said spanning topside deck and substantially the same width as a width of the central cargo tank; and at least one hatch opening formed in said pre-located topside deck of said vessel to provide access to said central cargo tank, said hatch opening having peripheral edge spaced away from and inboard of the pre-located port and starboard sidewalls of said central cargo tank so that said hatch opening and said topside deck remain substantially at a single elevation with minimal degradation of structural integrity of said topside deck.

2. The vessel of claim 1 wherein said wing tank internal longitudinal bulkheads comprise the sidewalls of the central cargo tank.

3. The vessel of claim 2 wherein said elevated floor comprises a plurality of bottom plates attached to each other and to the sidewalls and bulkheads.

4. The vessel of claim 3 wherein said plurality of bottom plates comprise a longitudinal framing system.

5. The vessel of claim 3 further comprising added support members for supporting the elevated floor above the outer hull.

6. The vessel of claim 5 further comprising added support members for supporting said wing tank internal longitudinal bulkheads.

7. The vessel of claim 5 wherein said central cargo tank includes a longitudinal bulkhead extending along a length thereof to form a plurality of central cargo tanks, at least one of said central cargo tanks having said elevated floor.

8. The vessel of claim 7 wherein each of said plurality of central cargo tanks has an associated elevated floor.

9. A vessel converted from a single outer hull construction with a spanning, single elevation, pre-located, topside deck into a double hull construction without alteration of the outer hull and maintaining the topside deck at a single elevation, said single hull vessel having a central cargo tank flanked on either side by pre-located port and starboard wing tanks, each of said wing tanks having pre-located internal longitudinal bulkheads defining the sidewalls of the central cargo tank, wherein said vessel is converted into double hull construction solely by adding an elevated floor spanning said sidewalls to define a sealed compartment separating the central cargo tank from the single hull, said spanning elevated floor being of substantially a single elevation and substantially parallel to said spanning topside deck and substantially the same width as a width of the central cargo tank; and at least one hatch opening formed in said pre-located topside deck of said vessel to provide access to said central cargo tank, said hatch opening having peripheral edge spaced away from and inboard of said pre-located internal longitudinal bulkheads of said central cargo tank so that said hatch opening and said topside deck remain at a single elevation with minimal degradation of structural integrity of said topside deck.

10. The vessel of claim 9 further comprising a plurality of transverse bulkheads, said transverse bulkheads defining the central cargo tank, said elevated floor extending between and attached thereto.

11. The vessel of claim 10 wherein said plurality of transverse bulkheads comprises more than 2 to thereby form a plurality of central cargo tanks, each of said central cargo tanks having an associated elevated floor.

12. The vessel of claim 11 wherein each of said elevated floors comprises a plurality of bottom plates attached to each other and to the sidewalls and bulkheads.

13. The vessel of claim 12 wherein each of said elevated floors comprises added support members for supporting each of the elevated floors above the outer hull.

14. The vessel of claim 10 wherein said central cargo tank includes a longitudinal bulkhead extending along a length thereof to form a plurality of central cargo tanks, at least one of said central cargo tanks having said elevated floor.

15. A method for converting a vessel from a single outer hull construction with a spanning, single elevation, pre-located, topside deck into a double hull construction without alteration of the single outer hull and maintaining the topside deck at a single elevation, said single hull vessel having a central cargo tank flanked on either side by pre-located port and pre-located starboard wing tanks, said central cargo tank being defined by pre-located port and pre-located starboard sidewalls and fore and aft transverse bulkheads, the method comprising adding an elevated floor in said central cargo tank, said elevated floor spanning said pre-located sidewalls and said pre-located bulkheads to define with said outer hull a sealed compartment separating the central cargo tank from the outer hull, said spanning elevated floor being of substantially a single elevation and substantially parallel to said spanning topside deck and substantially the same width as a width of the central cargo tank; and forming at least one hatch opening in said pre-located topside deck of said vessel, said hatch opening providing access to said central cargo tank, said hatch opening having a peripheral edge spaced away from and inboard of the port and starboard sidewalls of said central cargo tank so that said hatch opening and said topside deck remain substantially at a single elevation with minimal degradation of structural integrity of said topside deck.

16. The method of claim 15 further comprising adding support members for supporting said elevated floor above the outer hull.

17. The method of claim 15 wherein the step of adding an elevated floor includes installing a plurality of bottom plates.

18. The method of claim 17 wherein the step of installing a plurality of bottom plates includes installing a plurality of bottom plates that span the sidewalls and attaching adjacent bottom plates to span the bulkheads.

19. A vessel converted by the method of claim 15.

20. A vessel converted by the method of claim 18.

21. A vessel converted from a tanker vessel with a single hull construction and a spanning, single elevation, pre-located, topside deck into a bulk cargo carrying vessel with a double hull construction without alteration of said single outer hull and maintaining the topside deck at a single elevation, said single hull vessel having a central cargo tank flanked on either side by pre-located port and pre-located starboard wing tanks, each of said wing tanks having internal longitudinal bulkheads defining the sidewalls of the central cargo tank, wherein said vessel is converted into said bulk cargo carrying vessel with double hull construction by adding an elevated floor spanning said pre-located sidewalls to define a sealed compartment separating the central cargo tank from the single hull and by adding a hatch opening in a pre-located topside deck of the vessel above the central cargo tank to provide access to the central cargo tank, said hatch opening having a peripheral edge spaced away from and inboard of the longitudinal bulkheads of said central cargo tank so that said hatch opening and said pre-located topside deck remain substantially at a single elevation with minimal degradation of structural integrity of said topside deck; and said spanning elevated floor being of substantially a single elevation and substantially parallel to said spanning topside deck and substantially the same width as a width of the central cargo tank.

22. The vessel of claim 21 wherein said hatch opening is dimensioned in a manner to allow prefabricated modular sections of the elevated floor to be passed through the hatch opening when the elevated floor is installed in the central cargo tank.

23. The vessel of claim 21 wherein said hatch opening is dimensioned in a manner to allow a crane positioned above the hatch opening to access substantially all areas of the central cargo tank.

* * * * *